United States Patent [19]

Piesik

[11] 4,044,648

[45] Aug. 30, 1977

[54] ROCKET EXHAUST PLENUM FLOW CONTROL APPARATUS

[75] Inventor: Edward T. Piesik, Pomona, Calif.

[73] Assignee: General Dynamics Corporation, Pomona, Calif.

[21] Appl. No.: 617,337

[22] Filed: Sept. 29, 1975

[51] Int. Cl.[2] ..... F41F 3/04

[52] U.S. Cl. ..... 89/1.8; 89/1.812; 89/1.816

[58] Field of Search ..... 89/1.8, 1.812, 1.816, 89/1.819, 34; 206/3; 138/37; 137/512

[56] References Cited

U.S. PATENT DOCUMENTS

| | | | |
|---|---|---|---|
| 2,445,423 | 7/1948 | Eastman | 89/1.8 X |
| 2,925,013 | 2/1960 | Santora et al. | 89/1.8 |
| 3,052,303 | 9/1962 | Lapp | 89/1.8 UX |
| 3,228,296 | 1/1966 | Neuman et al. | 89/1.8 |

*Primary Examiner*—David H. Brown

*Attorney, Agent, or Firm*—Henry M. Bissell; Edward B. Johnson

[57] ABSTRACT

Apparatus for controlling the flow of exhaust gases between a plurality of rocket storage chambers, launch tubes or the like (herein referred to as chambers), and a common manifold for ducting rocket exhaust gases to a discharging location comprises a plurality of chamber-to-manifold flow transition sections, each having disposed within vertical portions thereof a pair of flow control doors. The flow control doors, pivotably mounted at upper portions in opposing relationship, are configured and counterbalanced to hang, in static conditions and under the force of gravity alone, in a fully or nearly fully closed condition. Alternatively, un-counterbalanced doors may be configured to hang, under static conditions, at least slightly inwardly inclined towards the vertical axis of the transition portion in which they are hung. During a rocket firing, manifold pressure causes doors in the transition sections, other than those through which a rocket is firing, to close and remain closed, thereby preventing circulation of rocket exhaust gases into non-firing rocket chambers. Flow control doors associated with firing rockets are caused to pivot towards a fully open condition by unbalanced moments acting thereon.

30 Claims, 9 Drawing Figures

ROCKET EXHAUST PLENUM FLOW CONTROL APPARATUS

BACKGROUND OF THE INVENTION

1. Field of the Invention

The present invention relates to the field of controlled flow, exhaust manifold systems and, more particularly, to apparatus for controlling the flow of exhaust gases between a plurality of rocket stations and a common exhaust gas manifold or plenum tube connected thereto.

2. Description of the Prior Art

In many military applications, numbers of rockets are stored or disposed in closely adjacent magazine chambers, launch tubes, or the like, hereinafter referred to collectively as chambers. Exhaust gas outlets are normally provided, even from magazine storage chambers, to duct rocket exhaust gases generated during intended or accidental rocket ignitions to a safe location. Where available space is at a premium, for example on ships, manifolding of a number of chambers into a common exhaust duct or plenum tube is often necessary.

Obvious problems exist if ducts connecting the chambers to the common exhaust manifold are always or normally open. When one (or more) of the rockets is intentionally or accidentally ignited, at least portions of the resulting exhaust gases, which may be at about 6000° F., will be circulated through the common manifold and into other chambers through the open connecting ducts. Rockets and rocket warheads in these other chambers are very likely to be ignited or be detonated by these hot exhaust gases. If these other rocket chambers are open at upper ends, as are launch tubes and some storage compartments, exhaust gases entering the chambers through the connecting ducts escape through the open ends and may cause extensive heat damage to adjacent installations.

To prevent such occurrences, some type of safety door or gas valve is normally installed either at the outlet opening of each rocket chamber or in the connecting duct to the exhaust manifold. When a rocket is accidentally or intentionally ignited, the associated safety door or gas valve is caused to open—usually by the exhaust blast—to admit the exhaust gases into the manifold. The doors or valves associated with other chambers are maintained in a closed condition to prevent circulation of the exhaust gases thereinto.

The patent disclosures, for example, of Eastman and Neuman et al. (U.S. Pat. Nos. 2,445,423 and 3,228,286, respectively) illustrate use of such doors or valves. Previously available or disclosed apparatus, however, have substantial disadvantages. For example, the patent of Neuman et al. discloses at the bottom of each compartment of a multiple rocket storage magazine, a non-hinged, "blow out" door. These doors lead through conducting ducts to a common exhaust manifold. If any of the rockets in the magazine are accidentally ignited (for example by enemy fire), the force exerted by the resulting rocket exhaust gas on the upper surface of an associated door blasts the door out of its opening and admits the gases into the manifold. An associated fire extinguishing system is designed to direct pressurized water through the resulting opening and extinguish the rocket. A major disadvantage, however, is that no means are provided for automatically reclosing the door after the rocket has been extinguished. Unless the blow-out door is manually replaced—for which little provision seems to have been made—hot exhaust gases from subsequent accidental ignition of another rocket would enter the compartment and could cause reignition of the rocket or explosion of its warhead before such next-firing rocket is extinguished. In addition, if the compartments are not sealed in upper regions—which they do not seem to be—hot exhaust gases from the next firing rocket would be conducted through any compartments containing previously ignited rockets and directly to the rocket launching platform positioned just above the magazine.

Another very substantial problem associated with the apparatus disclosed by Neuman et al., and other similar apparatus, is that little consideration appears to have been given to preventing recirculation of exhaust gases back into and through a chamber while a rocket is firing in that chamber. Whatever type of exhaust flow control door or valve is used, it must be suitably configured to prevent exhaust gases emitted therethrough and into the exhaust manifold from flowing around the exhaust stream and back into the rocket compartment. If this occurs, the gases may cause structural damage to portions of the rocket, ignition of other propellants (if the rocket has other stages) or detonation of the rocket warhead. Ignition of these other propellants or detonation of the warhead could ignite or detonate adjacent rockets and warheads, thereby initiating a disastrous chain reaction.

Merely to provide properly opening and closing rocket exhaust gas flow control doors is, therefore, insufficient; the doors must be configured so that at all exhaust flow conditions they will open only that amount which will cause the rocket exhaust stream to function as a complete "gas plug" in the opening to prevent recirculation of exhaust gases back into the chamber.

The patent of Eastman discloses apparatus adapted for storing a number of rockets, wherein exhaust nozzles of the rockets are seated in sealing relationship upon short ducts or nozzle extensions leading to a common exhaust manifold. Toggle clamps are used to hold the noses of the rockets in the storage apparatus and no actual storage compartments are formed. Each nozzle extension has, at its lower end, a pair of hinged doors, spring biased to a normally closed condition. Exhaust gas pressure from an accidentally ignited rocket forces the associated nozzle extension doors to swing open against the springs, thereby admitting the gases to the manifold, from which they are discharged at a remote location. The resulting gas pressure in the manifold acts upon under sides of other closed doors to force them tightly closed and prevent circulation of hot exhaust gases into the other nozzle extensions.

However, the door hinges and biasing springs are positioned directly in the path of hot exhaust gas flow from an above firing rocket and will receive maximum heating and erosion therefrom. As a result of heat and erosion damage, the doors immediately below a firing rocket, even if not burned completely loose, as is likely, would probably fail to return to the closed condition after the firing. Also, very possibly, heat from hot exhaust gases flowing through the manifold would damage the biasing springs of other doors. Even if these doors were kept closed by pressure in the manifold during that particular firing, they might subsequently sag open. Then, upon a next accidental rocket firing, the flow of gases through the manifold could force the sagging doors open, rather than closed, allowing circulation of the hot gases into above nozzle extensions with consequent ignition of the associated rockets.

Even though spring-loaded flow control doors might be satisfactory for use associated with storage of small rockets, wherein firing is unlikely and when it occurs the firing time is short, such doors would be entirely unsatisfactory in applications in which they would be subjected to repeated or sustained rocket exhaust gas flows. They would thus be unsatisfactory for use associated with storing or launching large rockets or with launch tubes from which a large number of even small rockets would be fired.

For these and other reasons, improvements in controlling flow of rocket exhaust gases associated with a plurality of rocket stations and a common exhaust gas manifold are not only desirable, but necessary.

SUMMARY OF THE INVENTION

Fluid flow apparatus, in accordance with the invention, comprises a plurality of high velocity, pressurized fluid sources; a common manifold, disposed below portions of the fluid sources and having a plurality of fluid inlet openings and a common fluid discharge opening; connecting means for connecting the fluid sources to corresponding manifold inlet openings and flow controlling means disposed in the connecting means for controlling fluid flow between the sources and the manifold. The connecting means comprises a plurality of flow transition sections, each transition section interconnecting a source and a corresponding manifold inlet opening, at least portions of the transition sections being normally substantially vertical. The flow controlling means includes a pair of flow control doors disposed within each vertical portion. The doors, pivotally mounted along opposing upper portions thereof for independent movement, are gravity biased to hang, in the absence of fluid pressure at the corresponding source or manifold inlet, with lower portions thereof at least slightly inwardly inclined from the vertical and towards each other. The doors are operative to pivot fully closed and remain closed in response to fluid pressure at the manifold inlet being greater than the fluid pressure at the source; they are also operative to pivot to different equilibrium degrees of openness in response to balancing of moments thereupon caused by the source pressures acting upon the source side of the doors and manifold pressures acting upon the manifold side of the doors.

More specifically, the fluid sources comprise rocket storage compartments, launch tubes, etc. and the fluid comprises hot rocket exhaust gases. Hinged portions of the doors are positioned to be out of the path of direct flow of the hot exhaust gases through the transition sections, and at least portions of the doors are heat protected by insulating or ablative materials. Additional hinge protection may be provided by packing the hinging areas with heat insulating material. High temperature seals are provided along edge portions of the doors to prevent gases from the manifold from flowing past the doors and back into the storage chamber, launch tubes, etc.

The doors, through which a rocket is firing, are caused to pivot open to an equilibrium position determined by the balance of moments on inner and outer surfaces of the doors, the equilibrium position varying as the exhaust gas flow varies. The doors and the transition section are configured so that at each equilibrium position, the flow of exhaust gases between the doors acts as a plug to prevent flow of exhaust gases back through the doors and into the chamber, launch tube, etc.

The flow control doors are preferably counterweighted to hang, under by the action of gravity and in static conditions, fully or nearly fully closed, the doors in such closed condition preferably being at an angle of less than about 30° from the vertical.

Elongate gas deflectors are fixed to inside surfaces of the manifold in locations of the inlet openings, at about the central plane of the manifold. Lower deflector surfaces which project outwardly into the manifold and which are concave upwardly, divert exhaust gases, which tend to flow upwardly from the bottom of the manifold, away from manifold inlet openings.

To achieve the desired configuration of the doors and the transition elements, ends of the transition sections are inclined outwardly along the axis of the manifold, and sides of the transition section are correspondingly inclined inwardly in bottom portions thereof.

The apparatus, since no spring biasing is employed and the hinge portions and door are heat protected, is well suited for use in applications having a plurality of rocket launch tubes, the doors of which are subject to repeated exposure to hot exhaust gas flows and, as well, for applications in which large rockets are installed in a plurality of rocket storage compartments wherein, during an accidental firing, the associated doors may be subjected to a lengthy flow of hot exhaust gases.

BRIEF DESCRIPTION OF THE DRAWINGS

A better understanding of the present invention may be had from a consideration of the following detailed description, taken in conjunction with the accompanying drawings, in which.

DESCRIPTION OF THE PREFERRED EMBODIMENT

Figure 1:
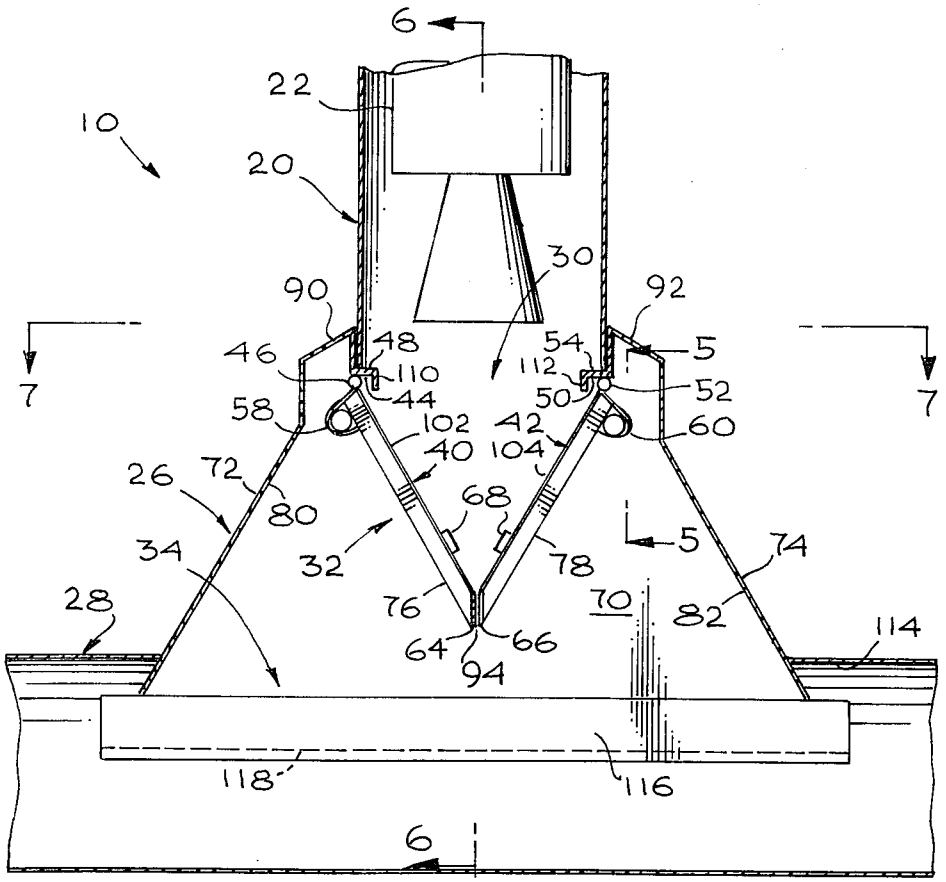
FIG. 1 is a vertical sectional view of the rocket exhaust flow control apparatus, showing the flow control doors counterbalanced to a fully closed condition.
Figure 7:
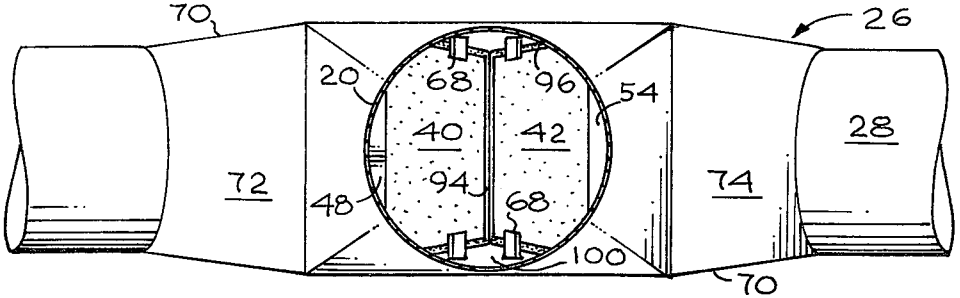
FIG. 7 is a horizontal sectional view along line 7—7 of FIG. 1, showing the flow control doors in a fully closed condition.

Referring to FIG. 1, and described briefly, a rocket storage or launch station or site 10 comprises a chamber 20, which contains a rocket 22, an exhaust gas flow transition section or duct 26 and an exhaust manifold or plenum tube 28, the transition section 26 interconnecting the chamber 20 and the manifold 28. Considered together, the rocket 22 and the chamber 20 function, when the rocket engine is fired, as a source of a high velocity, pressurized fluid—specifically, rocket exhaust gases.

The chamber 20, which is merely representative of any type of rocket storage compartment, launch tube, test firing stand or the like, may be closed or open at the top and sides. Within the chamber 20, the rocket 22 is supported in a conventional manner (not shown), and need not be positioned along, or even exactly parallel to, the chamber axis. At the bottom of the chamber 20 an outlet opening 30 permits exhaust gases from the rocket 22, when fired, to flow into the transition section 26. Flow control means 32 are disposed in the transition section 26 to control flow of exhaust gases therethrough, as more particularly described below.

An inlet opening 34 is provided into an upper portion of the manifold 28 from the bottom of the transition section 26. The manifold 28 and manifold inlet openings 34 are disposed a sufficient distance below the level of the chamber outlet opening 30 to allow the flow control means to be disposed in normally vertical portions of the transition sections 26, for reasons to become apparent. The chamber 20 need not, however, be vertically disposed above the manifold, as is shown in the accompanying drawings; the chamber 20 may alternatively be inclined at substantially any angle from the vertical, the transition section having suitably angulated portions to effect the interconnecting.

Figures 2, 8:
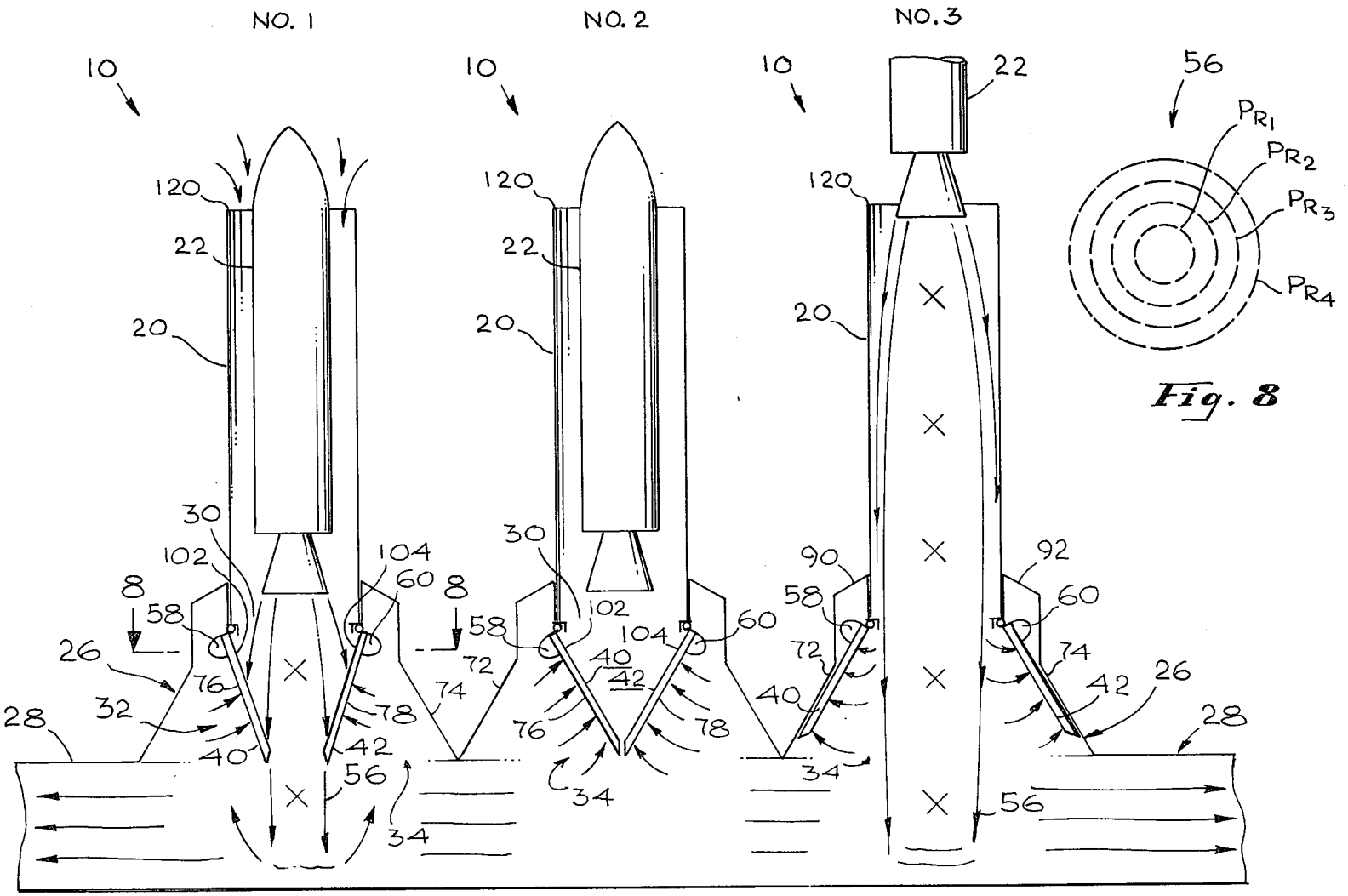
FIG. 2 is a vertical schematic veiw, showing three launch stations connected to a common exhaust manifold, and also showing two different rocket firing conditions.
FIG. 8 is a horizontal sectional view along line 8—8 of FIG. 2, showing concentric pitot pressure rings of the exhaust flow stream.

The apparatus herein described relates primarily to applications in which a plurality of stations 10 is connected to a common manifold 28 such that control of rocket exhaust gases into and from the manifold is required. As an example, FIG. 2 illustrates three such stations 10 arranged in spaced relationship along the manifold 28, although more than three may be employed. The stations 10 are substantially identical and are identified for purposes of discussion (from left to right in the figure) as stations Nos. 1, 2 and 3.

Referring again to FIG. 1, the flow control means 32 comprises a pair of opposing flow control doors or panels: a first door or panel 40 and a second door or panel 42, both doors being substantially identical. The door 40 is pivotably attached along an upper, inner edge 44, by hinge 46, to an inwardly projecting first edge portion 48 of the transition section 26; similarly, the door 42 is pivotally attached along an opposing upper, inner edge 50, by a hinge 52, to an opposite, inwardly projecting second edge portion 54 of the transition section.

The doors 40 and 42 pivot closed under the action of pressure in the manifold 28, as more fully described below, to prevent exhaust gases from flowing from the manifold 28 upwardly through the transition section 26 and into the chamber 20 when a rocket 22, in a different rocket station 10, is firing (condition of doors 40 and 42 in station No. 2, FIG. 2). The doors 40 and 42 pivot open, under combined action of pressure in the manifold 28 and pressure of exhaust gases emitted from the above rocket 22 when it fires, just that amount that causes an exhaust stream 56 (FIG. 2, station Nos. 1 and 3) flowing downwardly between the open doors to function as a gas plug preventing flow of exhaust gases from the manifold 28 back through the doors and upwardly into the chamber 20.

As shown in FIGS. 1, 2 and 4–7, the doors 40 and 42 are counterbalanced by weights 58 and 60, respectively, fixed to upper, outer portions of the doors. The counterbalancing weights may be disposed external to the transition section, since the hinge line may penetrate the transition section wall if proper seals are provided. The weights 58 and 60 are preferably configured so that when the chamber 20 and the transition section 26 are vertically disposed the doors 40 and 42 hang, under the action of gravity alone and under static, non-firing conditions, fully closed (FIG. 1) or very nearly fully closed. That is, the combined weight of the doors 40 and 42 and the weights 58 and 60, as well as the positioning of the hinges 46 and 52, cause the doors 40 and 42 to barely close so that lower edges 64 and 66, respectively, thereof are in light contact under the static condition of no exhaust gas pressure acting on either side of the doors. Preferably, when fully closed, the doors 40 and 42 are at an angle of about, or less than about, 30° with the vertical; although, the doors function properly, at closing angles of as much as 90° (that is, when they are horizontal when closed). Counterbalancing to force the doors 40 and 42 tightly closed under static conditions is both unnecessary and undesirable, as will become apparent from the subsequent discussion.

Figure 3:
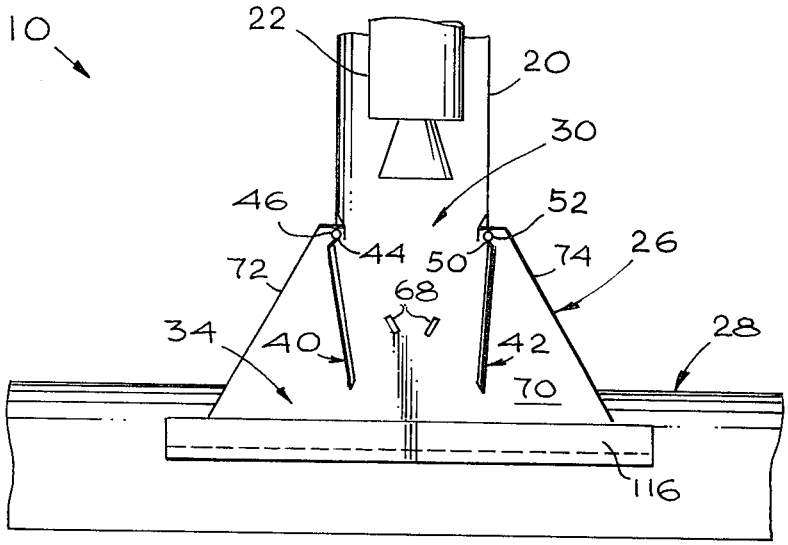
FIG. 3 is a vertical sectional view of the exhaust gas flow control apparatus, showing non-counterweighted flow control doors hanging in an open, nearly vertical configuration.

The doors 40 and 42 need not, however, be counterbalanced to fully or nearly fully close under static conditions. Tests indicate that as long as the doors 40 and 42 are configured so they hang, under static conditions, even only slightly inclined inwardly towards the longitudinal, vertical axis of the transition section 26, their operation will still be entirely satisfactory. For example, the doors 40 and 42 will operate properly even if they hang under static condition nearly vertically, as illustrated in FIG. 3. If the doors 40 and 42 are hung in such nearly vertical, static condition, the weights 58 and 60 are generally unnecessary, provided the doors are hung in an eccentric condition from upper, forward edges 44 and 50.

Figure 4:
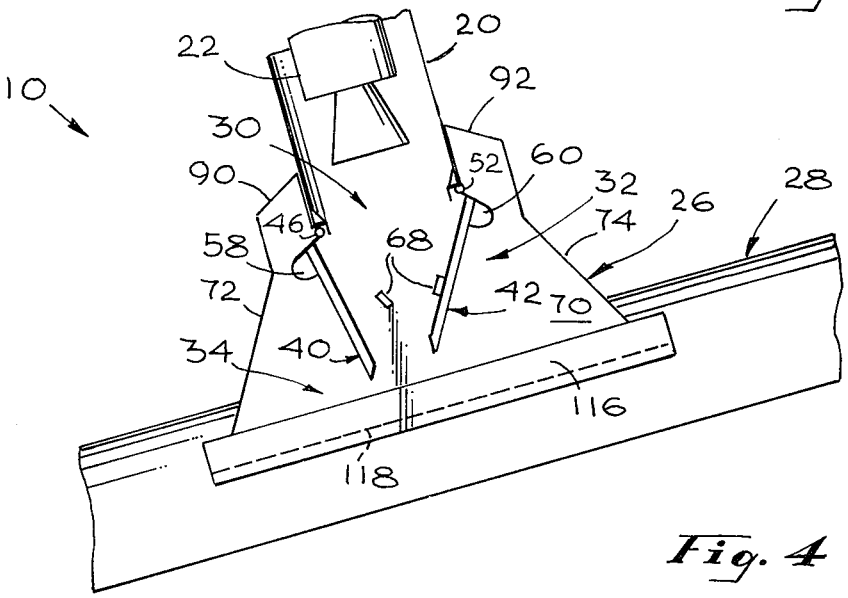
FIG. 4 is a vertical sectional view of the apparatus of FIG. 1 showing the entire launch station tilted, and showing the effect thereof on the flow control doors.

Important advantages are nevertheless associated with counterbalancing the doors 40 and 42 to hang in a closed condition under static conditions. In many applications, particularly ship-board use, the entire rocket station 10 may, at least at times, be tilted from the level condition (FIG. 4). If the doors 40 and 42 are not counterweighted, and therefore hang nearly vertically under level conditions (FIG. 3), one of the doors will be inclined away from, rather than towards, the transition section longitudinal axis when the station 10 is tilted even a small amount. Both of the doors 40 and 42 may not then be properly closed by manifold pressure when another rocket 22 is fired and when the rocket above is fired, the outwardly inclined door may be swung so far open that the exhaust stream 56 is not completely effective as a plug, and exhaust gases may recirculate from the manifold 28 back into the chamber 20.

Counterbalancing the doors 40 and 42 to a closed or nearly closed static condition when the station 10 is level, even though when the station 10 is tilted one door may pivot toward the open condition, insures that both doors will still remain inclined (though not symmetrically) toward the transition section for all practical angles of tilt of the station 10 (FIG. 4), and will thus be in condition for proper functioning. Operation of the doors under tilt conditions is further assured by stops 68 which are fixed to the inside of the walls 70 of the transition section 26 at locations preventing either of the doors 40 or 42 from swinging past their normal, fully closed position.

There is also a psychological advantage to counterbalancing the doors 40 and 42 closed under static conditions, even if the station 10 will not be subject to any tilting. Although in actual practice the doors 40 and 42 will function properly even when hanging nearly vertically open under static conditions, it is not immediately apparent to even a non-casual observer that such will be the result. For example, it is not apparent that pressure in the manifold will close open hanging doors of non-firing stations. Therefore, the system appears more functional if the doors 40 and 42 are counterweighted to the closed static condition. Since, however, mechanical malfunctions could conceivably prevent the doors 40 and 42 from pivoting closed from a static, open-hanging condition, a safety factor is provided if the doors are counterbalanced in the described manner.

For some conditions of an above rocket 22 firing, and as more particularly described below, the doors 40 and 42 will be forced by exhaust gas pressure to a partially open, equilibrium position as shown at station No. 1 FIG. 2. Under other equilibrium conditions the doors 40 and 42 will be forced to a fully open condition in which they must be inclined away from, rather than toward, the vertical (station No. 3, FIG. 2). To provide for such fully open condition, the transition section 26 is formed in a trapezoidal configuration, with lower portions of end walls 72 and 74 of the transition section being inclined outwardly from the vertical along the axis of the manifold, as may be seen in FIGS. 1 and 2. To allow the doors 40 and 42 to fully open, with outer surfaces 76 and 78 of the doors in contact with corresponding inner surfaces 80 and 82 of the end walls 72 and 74, upper portions 90 and 92 of the end walls are formed outwardly to clear the weights 58 and 60.

Edge sealing of the doors 40 and 42, to prevent exhaust gas leakage therepast, is provided by a high temperature gas seal 94 attached along one of both lower doors edges 64 and 66 (FIG. 1). Because the sides 70 of the transition section 26 are generally inwardly inclined (FIGS. 4 and 6 and as more fully described below) and the doors 40 and 42 are not exactly rectangular, flexible or slidable, high temperature seals 96 are provided along side doors edges 98. The seals 96, which contact inner surfaces 100 of the sides 70, flex, or slide inwardly along the doors 40 and 42, to provide side edge sealing regardless of door positions.

At least inner surfaces 102 and 104 (FIG. 1) of the doors 40 and 42 are insulated with a layer or coating (not shown) of a heat insulating material to protect the doors from high temperature effects, particularly of impinging rocket exhaust gases. The thickness of the insulating layer depends, according to well known principles, upon the maximum exhaust gas flow rate and total exhaust mass flow. Alternatively, at least the inner door surfaces 102 and 104 may be coated with suitable ablative material.

The hinges 46 and 52 are protected from temperature effects of the exhaust gases by being positioned out of the exhaust gas stream and by being shielded by downwardly extending flanges 110 nd 112, respectively, formed on transition section portions 48 and 53. Additional heat protection may be provided, for example, by covering or packing the hinge area with conventional heat insulating materials in a manner shown (FIGS. 3 and 4).

Figure 6:
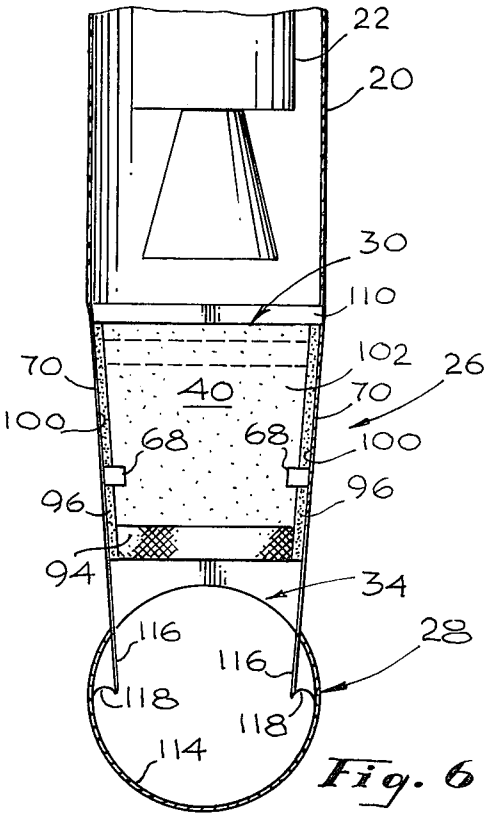
FIG. 6 is vertical sectional view along line 6—6 of FIG. 1, showing other features of the apparatus.
Figure 5:
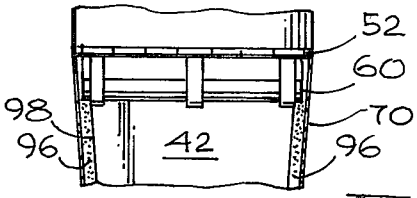
FIG. 5 is vertical sectional view along line 5—5 of FIG. 1, showing upper portions of one of the flow control doors.

Particularly when the diameter of the manifold 26 is small compared to the supersonic length of the rocket exhaust stream 56, exhaust gases downwardly impinging onto the bottom of the manifold 28, through the manifold inlet opening 34, may create such high pressures that the gases reverse direction and flow upwardly along inner walls 114 of the manifold and back into the transition section 26. Elongate, axial flow diverters 116 are fixed, in opposing relationship, along opposite sides of the manifold wall 114 in the region of the inlet opening 34 to prevent such a return flow, opposite ends of the elements being extended beyond axial ends of the inlet opening 34. Assuming a generally horizontal inlet opening 34, the elements 116 are located with lower arcuate surfaces 118 in a horizontal plane passing about through the center of the manifold 28 (FIG. 6). The surfaces 118, concave upwardly and projecting outwardly from the wall 114, divert exhaust gases flowing upwardly along the wall and cause them to flow axially along the manifold 28, rather than upwardly into the opening 34.

OPERATION

When a rocket 22 in any station 10 is ignited, the exhaust gases flowing into the manifold 28 pressurize the manifold. The resulting closing moment on doors 40 and 42 of other stations (equal to the manifold pressure times the area of outside door surfaces 76 and 78) forces those doors, if they were initially hanging open, to a fully closed condition and maintains the doors closed as long as the manifold pressure is slightly above the pressure in the above chamber 20.

Before the firing rocket 22 starts to lift from the chamber 20, and during a constrained firing, (station No. 1, FIG. 2) the doors 40 and 42 below that chamber tend to be pivoted open by the force of the impinging exhaust gases. If the weights 58 and 60 are greater than required to just close the doors 40 and 42, pressure must be built up above the doors until the "excessive" counterweighting is overcome. During this period of pressure build up, the contained exhaust gases may cause damage to the rocket 22 or its surroundings; therefore, such excessive counterbalancing should be avoided. As the doors 40 and 42 are pivoted open, they normally reach an equilibrium, non-fully open, position when the opening moment caused by the impinging forces of the rocket exhaust acting on inside door surfaces 102 and 104 just equals the closing moment caused by the manifold pressure acting on the outside door surfaces 76 and 78. When the rocket exhaust flow varies with time, for example, in the case of a launched rocket, the impingement force and manifold pressure both vary with time; thus, the doors 40 and 42 continuously pivot to new equilibrium positions.

As a launched rocket 22 travels up and out an upper opening 120 of the chamber (station No. 3, FIG. 2) the exhaust stream 56 expands and completely fills the chamber cross section in lower regions thereof. To prevent restricted exhaust gas flow under such conditions, the cross sectional flow area through the transition section 26 and the manifold 28 should be at least as large as the chamber 20 cross sectional flow area. The manifold 28, given a particular chamber diameter, can usually be constructed to have this required cross sectional flow area.

As the rocket 22 moves away from the opening 30, the exhaust gases, directly impinging on increasingly larger areas of inside door surfaces 102 and 104, cause the doors finally to pivot fully open. It is apparent that the transition section 26, in the region of the doors 40 and 42, should, therefore, have a substantially uniform flow cross section (between the doors) to prevent restricted flow.

During a firing, air and gases above the doors 40 and 42 at the firing station become entrained into the exhaust stream 56, thereby reducing the pressure in the chamber 20 and drawing outside air into the upper opening 120 of the chamber (station No. 1, FIG. 2). Particularly if the upper end of the chamber 20 is closed, a partial vacuum is created in the chamber.

A typical control door 40 and 42 and transition section 26 design requires consideration of the following parameters: the ballistic values of the rocket motor, (including chamber pressure, flow rate, combustion temperature and throat diameter), cross sectional flow area of the chamber 20, maximum chamber design pressure during a normal launch, cross sectional flow area of the manifold 28, pressure in the manifold resulting from the maximal exhaust flow rate, allowable height of the transition section and a theoretical or experimental description of the rocket exhaust flow field, as a function of time, axial and radial directions (the required flow elements being: pitot pressure, static pressure or local ambient pressure ($P_{AMB}$), static temperature, total temperature, velocity, Mach number, gas constant, and specific heat ratio).

Figure 9:
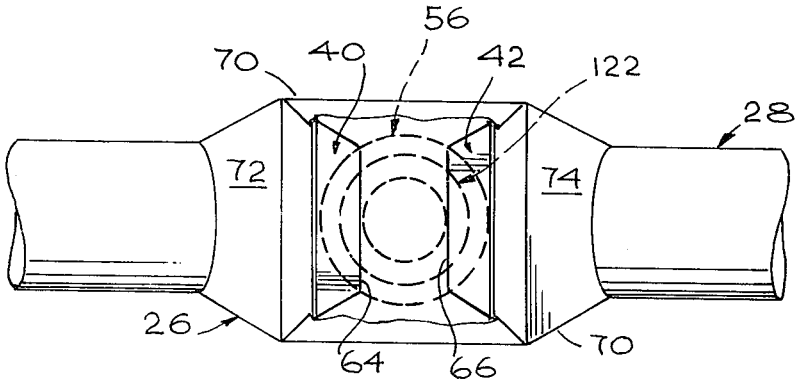
FIG. 9 is a horizontal sectional view in the plane of FIG. 7, showing the flow control doors in a partially open, equilibrium position.

The design proceeds generally in the following manner: the top dimensions of the doors 40 and 42 and the transition section 26 are established by the chamber 20 end dimensions and/or the chamber flow area. If the chamber is circular in cross section, a transition to rectilinear dimensions is made. Dimensions of the lower door edge 62 and 64 are determined by the requirement that the opening across such lower edges must be completely engulfed by the exhaust pitot pressure, $P_R$, that is at least as great as the static pressure in the manifold 28. Any particular cross section of the exhaust stream (or flow field) 56 can be substantially described as a series of concentric $P_R$ rings, as seen in FIG. 8, wherein $P_R$ increases towards the axis of the exhaust flow 56, $P_{R1}$ being greater than $P_{R2}$, which is greater than $P_{R3}$, which is in turn greater than $P_{R4}$, $P_{R4}$ being equal to $P_{AMB}$. The static pressure in the manifold 28 is determined in a conventional and well known manner from the mass flow rate and static properties of the exhaust and from the manifold cross sectional area. As seen in FIG. 9, $P_R$ inside a diameter 122 determined by the equilibrium open position of the doors 40 and 42 under a particular firing condition, must be at least as large as the manifold static pressure to prevent gases in the manifold from flowing back up into the chamber 20.

If the rocket motor ballistics vary with time, so does the exhaust pressure field, and so does the pressure in the manifold 28 for a fixed manifold cross sectional flow area. The initial design is based on the maximum expected rocket flow rate (and ballistics) and is checked at lesser flow rates to assure the manifold pressure does not exceed the exhaust pitot pressure at the new equilibrium door position. If it does, then to prevent back flow, dimensions of the lower door edges 64 and 66 must be made smaller so that a higher exhaust pitot pressure will result at the bottom opening of the doors.

To accommodate a comparatively large number of chambers 20 along manifold 28, the lengths of the manifold inlet openings 34 are minimized. Since the flow area into the manifold 28 must be at least equal to the flow area of the chamber 20 during a normal launch and as the doors swing fully open, it is desirable that the dimensions of the lower door edges 64 and 66 be as large as feasible within the above constraints.

With the top and bottom dimensions of the doors 40 and 42 established, according to the foregoing criteria, the length (or height) of the doors is determined, based upon the equilibrium between the moments on the inside and outside door surfaces 102 and 104, and 76 and 78, respectively. The pressure in the manifold 28 is considered to act substantially uniformly on the outside door surfaces 76 and 78 to produce a closing moment which is opposed by the exhaust flow, non-uniform impingement pressure load integrated over the inside door surfaces 102 and 104. After the top and bottom dimensions of the doors 40 and 42 and the pressure in the manifold 28 have been established, the balancing of such moments becomes a function of door area, door length, the exhaust impingement angle with respect to the inside door surfaces 102 and 104 and the region of impingement in the exhaust stream 56 (which determines a recovery pressure at a particular subsonic or supersonic Mach number of the exhaust), the impingement becoming less intense as the doors swing away from their closed position.

The final configuration which balances the moments must also be in agreement with the criteria used to determine the dimensions of the lower door edges 64 and 66. If this is not the case, an iteration of the design is performed.

The angle of the transition section sides 70 and the height of the transition section 26 follow the final geometry of the doors 40 and 42.

Preferably the angle between the center line of the exhaust stream 56 and the doors 40 and 42 and the transition section sides 70 should always be less than about 30° for any door equilibrium position, so that normal (right angle) pressure shocks, with attendant high heating rates, are unlikely to occur at the doors or side walls. In addition, if the mentioned angle is large, the possibility increases that some exhaust gases from the upper portion of the transition section 26 will recirculate back into the chamber 20.

Although there has been described above a specific arrangement of rocket exhaust plenum flow control apparatus in accordance with the invention for the purpose of illustrating the manner in which the invention may be used to advantage, it is to be appreciated that the invention is not limited thereto. Accordingly, any and all modifications, variations or equivalent arrangements which may occur to those skilled in the art should be considered to be within the scope of the invention as defined in the appended claims.

What is claimed is:

1. Controlled fluid flow apparatus comprising:

a. a plurality of fluid flow elements;

b. a common manifold;

c. means for connecting said elements to said manifold in fluid exchange relationship, said connecting means including a plurality of transition sections adapted for separately directing pressurized fluid from said elements into said manifold; and d. means for controlling the flow of pressurized fluid through said transition sections, said controlling means including a plurality of pairs of flow control doors and means for pivotably hanging the doors in opposing relationship by pairs in corresponding portions of the transition sections, said doors of each of said pairs being configured to hang, under the action of gravity alone, at least slightly inclined toward one another and being operative to pivot to a fully closed position in response to back pressure in the associated transition section when pressurized fluid is flowing through any non-associated transition section into the manifold, and being operative to pivot to just that degree of openness required to prevent fluid backflow when pressurized fluid is flowing through the associated transition section into the manifold.

2. The invention as claimed in claim 1, including counterbalancing means for causing said pair of doors to hang, under the action of gravity alone, in said fully closed position in the absence of said pressurized fluid on both sides of said doors.

3. The invention as claimed in claim 1, wherein said doors are inclined at an angle of less than about 30° to the longitudinal axis of an associated vertical portion when in said fully closed position.

4. The invention as claimed in claim 1, wherein said transition sections include means for limiting pivotable movement of each of said doors in said pair of doors, to thereby cause said doors to stop at said fully closed position, whereby said doors, when pivoted from an open position, are caused to close in symmetrical manner and whereby neither of said doors will close further than the other of said doors.

5. The invention as claimed in claim 1, including deflection means disposed axially along opposing inner side wall portions of said manifold in the region of said manifold inlet openings for causing high velocity pressurized fluid flowing circumferentially around said inner walls towards said inlet openings to be diverted and caused to flow axially along said manifold.

6. The invention as claimed in claim 5, wherein said deflection means includes elongate deflecting elements attached to said inner walls and having radially inwardly projecting lower surfaces, said lower surfaces having a cross section generally concave upwardly towards said inlet openings.

7. The invention as claimed in claim 1, wherein along a vertical cross section along a longitudinal axis of the manifold said sections are generally trapezoidal, opposite end portions including opposing first and second walls thereof being inclined outwardly in the region of said transition section attachment, whereby when a pair of said doors are pivoted to a fully opened position, having portions thereof lying substantially along insides of said outwardly inclined portions, lower portions of said doors are spaced farther apart than are upper portions thereof.

8. The invention as claimed in claim 7, wherein lower distinct opposite side portions including opposing third and fourth walls of said transition sections are inclined inwardly towards each other to cause, when said doors are in said fully opened position, the horizontal cross sectional fluid flow area through at least the portion bounded by said fully opened doors and adjacent side portions of said transition sections to be substantially equal at all elevations along said doors.

9. The invention as claimed in claim 8, including sealing means disposed along side edges of said doors for causing fluid sealing between said side edges and said adjacent side portions of said transition section, regardless of the angle to which said doors are pivoted.

10. The invention as claimed in claim 9, wherein said sealing means includes sealing elements flexing inwardly against said transition section side portions.

11. The invention as claimed in claim 1, wherein said fluid comprises hot exhaust gases and wherein said means for pivotably hanging said doors is positioned to be out of the path of direct flow of said hot exhaust gases through said transition sections.

12. The invention as claimed in claim 11, wherein said elements comprise rocket storing stations.

13. The invention as claimed in claim 11, wherein said elements comprise rocket launch tubes.

14. The invention as claimed in claim 11, including means for protecting from effects of said hot exhaust gases said means for pivotably hanging said doors.

15. The invention as claimed in claim 14, wherein said means for protecting said hanging means includes heat insulating material disposed adjacent to at least portions thereof.

16. The invention as claimed in claim 11, including means for protecting at least portions of said doors from effects of said hot exhaust gases.

17. The invention as claimed in claim 16, wherein said protecting means includes heat insulating material.

18. The invention as claimed in claim 16, wherein said protecting means includes ablative material applied to portions of said doors.

19. In combination with a plurality of rocket storage or launch stations and a common rocket exhaust gas manifold for carrying exhaust gases from said stations to a discharging location, outlet openings of said station being disposed at an elevation above inlet openings of said manifold, apparatus for controlling flow of said exhaust gases between said station outlet openings and said manifold inlet openings, which comprises:

a. ducting means for connecting said station outlet portions to corresponding ones of said manifold inlet portions, said ducting means including a plurality of transition sections, each of said sections connecting a different one of said station outlet openings to a corresponding one of said manifold inlet openings, at least portions of said transition section being normally vertically disposed, and b. flow control means for controlling flow of said exhaust gases through said ducting means, said flow control means including a plurality of pairs of flow control doors, a pair of said flow control doors being pivotally mounted within said vertically disposed portions of each of said transition sections, each of said pairs of said doors being configured to hang, under the action of gravity and in the static condition of absence of exhaust gas pressure in said manifold and associated stations, at a predetermined inwardly inclined angle to the vertical, said doors of each of said pairs of doors being pivotally mounted at upper portions for lower portions thereof to swing towards each other for restricting and stopping flow of said exhaust gases through the associated transition section and for said lower portions to swing away from each other for enhancing flow of said exhaust gases through the associated transition section, said swinging of said doors being responsive to exhaust gas pressures in said stations and said manifold, said pairs of doors being caused to swing to a fully closed condition when said exhaust gas pressure in said manifold exceeds the pressure of an associated site by a predetermined amount, and being caused to swing towards a fully open position when a rocket in the associated station is firing.

20. The apparatus as claimed in claim 19, wherein said pairs of doors being caused to swing, when a rocket in the associated station is firing, to a partially open condition when the flow of said exhaust gases from said associated station through the associated transition section functions to swing the associated door opening, preventing flow of the exhaust gases from said manifold back through the associated transition section.

21. The apparatus as claimed in claim 19, wherein said doors are counterbalanced to hang, under the action of gravity and in said static condition, in a substantially fully closed condition.

22. The apparatus as claimed in claim 19, including sealing means for sealing side and lower edge portions of said doors to prevent the flow of said exhaust gases therepast.

23. The apparatus as claimed in claim 19, wherein said doors, when in said fully closed condition, are at an angle of less than about 30° with the longitudinal axis of said vertical portion of said transition section.

24. The invention as claimed in claim 19, including means associated with said vertical portions of said transition sections for preventing both doors of a pair of said doors from pivoting past the fully closed condition.

25. The apparatus as claimed in claim 19, wherein pivotal mounting portions of said doors are positioned to be out of the direct flow path of said exhaust gases through the associated transition section, and wherein at least inner exposed portions of said doors are protected against the heating effects of said exhaust gases.

26. The apparatus as claimed in claim 19, including diverting means fixed along inside surfaces of said manifold in proximity to said manifold inlet openings for causing exhaust gases flowing upwardly along insides of said manifold to be diverted axially along said manifold, whereby flowback into an associated transition section is substantially prevented.

27. The apparatus as claimed in claim 19, wherein, when exhaust gases are flowing through an associated transition section from an above firing rocket, said pair of doors are configured and operative to swing to a partially open condition having a flow pressure through the lower portions of the doors greater than the pressure in adjacent portions of the manifold, whereby gas backflow through the doors is prevented.

28. The apparatus as claimed in claim 19, wherein said vertical portions of said transition sections are disposed immediately above said manifold.

29. The invention as claimed in claim 28, wherein end portions of said vertical portions are outwardly inclined from the vertical, whereby lower portions thereof are spaced further apart than upper portions thereof.

30. The apparatus as claimed in claim 29, wherein said portions of said vertical portions are inwardly inclined from the vertical, whereby lower portions thereof are spaced closer than upper portions thereof.

* * * * *